United States Patent [19]

Wu

[11] 4,086,997

[45] May 2, 1978

[54] ADJUSTABLE SUPPORT FOR PRINT HEAD ASSEMBLY

[75] Inventor: Edward S. Wu, Chelmsford, Mass.

[73] Assignee: Wang Laboratories, Inc., Lowell, Mass.

[21] Appl. No.: 774,975

[22] Filed: Mar. 7, 1977

[51] Int. Cl.[2] ..... B41J 3/10

[52] U.S. Cl. ..... 400/57; 101/93.05; 400/59; 400/124

[58] Field of Search ..... 197/1 R; 101/93.04, 101/93.05

[56] References Cited

U.S. PATENT DOCUMENTS

| | | | |
|---|---|---|---|
| 3,759,359 | 9/1973 | Stellmach | 197/1 R |
| 3,882,985 | 5/1975 | Liles | 197/1 R |
| 3,935,936 | 2/1976 | Wilczewski | 197/1 R |
| 3,960,256 | 6/1976 | Bickoff et al. | 197/1 R |
| 4,010,835 | 3/1977 | Martin et al. | 197/1 R |
| 4,010,834 | 3/1977 | Linder | 197/1 R |
| 4,023,662 | 5/1977 | Perucca | 197/1 R |
| 4,024,940 | 5/1977 | Hendrischk et al. | 197/1 R |

*Primary Examiner*—Paul T. Sewell

[57] ABSTRACT

A printer is disclosed which has an adjustable support for the print head assembly, either or both for changing the spacing between the print head and paper supporting surface to accommodate multiple sheets of paper and to facilitate paper and ribbon changing and for changing the vertical position of the print head into one of two or more discrete positions to effectively at least double the number of dot positions available for printing from the print head wire array.

9 Claims, 4 Drawing Figures

ADJUSTABLE SUPPORT FOR PRINT HEAD ASSEMBLY

This invention relates to printers of the type having a movable print head assembly and, more particularly, to the adjustment of the print head assembly of such printers.

BACKGROUND OF THE INVENTION

Dot matrix printers, in particular because of the limited available travel of their print wires, as well as certain other types of printers, must have their head assembly closely spaced from the surface of the paper upon which their wires print through the interposed ribbon. In order to accommodate multiple sheets of paper when multiple copies are desired, it is necessary that the print head be adjustable in a direction toward and away from the surface upon which the paper is supported during printing to vary the spacing therebetween. It is also desirable that the print head be retractable away from the support surface to facilitate paper and ribbon changing. Heretofore such adjustment has generally been accomplished by slideably mounting the print head on its carriage, which makes adjustment difficult when the printer is operating.

In another aspect of dot matrix printers, it may be desirable to displace the dot matrix printer wire array in a vertical direction into one of two or more discrete positions to effectively at least double the number of dot positions available for printing from the print head wire array, for example, to produce a more readable pattern by overlapping the printed dots, or to make possible the use of fewer print wires. The latter is suggested, for example, in U.S. Pat. Nos. 3,757,346 and 3,759,359, both of which disclose print head carriage mounted mechanisms for accomplishing the result.

BRIEF DESCRIPTION OF THE INVENTION

It is a major object of the present invention to provide novel, improved and simplified mechanisms for accomplishing the adjustment of a dot matrix or other movable printer head, in either or both a horizontal direction toward and away from the paper support surface or in a vertical direction generally parallel to the paper support surface.

It is another object of the invention to provide a novel mechanism for adjusting the spacing of the print head from the paper support surface for accommodating multiple sheets of paper and for facilitating paper and ribbon changing.

It is still another object of the invention to provide a novel mechanism for adjusting the spacing of the print head from the paper support surface even while the print head is in motion.

It is still another object of the invention to make possible the use of a dot matrix print head having fewer print wires than would otherwise be necessary to produce a suitably legible symbol by providing a novel mechanism for adjusting the vertical position of the print head into one of two or more discrete positions to effectively at least double the number of dot positions available from the print head wire array.

It is a still further object of the invention to improve symbol legibility by providing closer dot spacing than would otherwise be possible from a single row wire array, or even by overlapping dots which is impossible with a single row wire array, by providing a novel mechanism for adjusting the vertical position of the print head selectively into one of two or more discrete positions.

The above and still further objects of the present invention are accomplished, in general, by providing a printer including a frame having end portions and a paper support surface extending transversely therebetween, a print head assembly transversely movable along a printing line parallel to the paper support surface and spaced therefrom and support means adjustably supporting and guiding the print head for movement along the printing line and for adjustment in one or more directions perpendicular to the printing line. The support means of the invention includes, in general, at least one, and preferably two, cylindrical print head assembly support members, preferably mounted on the frame for limited angular displacement about axes parallel to and displaced from the axis of said supporting member. Operating means are provided for displacing the supporting members to move the print head assembly in a direction perpendicular to the printing line for adjusting thereof, either toward and away from or parallel to the paper support surface, or both.

In one specific aspect of the invention, novel mechanism is provided for horizontally adjusting the spacing of the print head from the paper support surface, even while the print head is operating, for accommodating multiple sheets of paper and for facilitating paper and ribbon changing. In such mechanism, one of the support members, preferably the front one, is cylindrical and extends through a bore in the print head assembly for sliding and pivotal movement thereon; bearing means are provided for mounting that support member on the frame for angular displacement about an axis parallel to and displaced from its axis. Operating means are provided for angularly displacing that support member to move the print head assembly in a horizontal direction toward and away from the paper support surface.

The print head assembly is preferably mounted on the other of the support members for movement toward and away from the paper support surface. The print head assembly may have roller means rotatable about a horizontal axis perpendicular to the axis of the other support member supporting the print head assembly for both sliding and pivotal movement.

In another specific aspect of the invention, novel mechanism is provided for adjusting the vertical position of the dot matrix print head into two or more discrete positions, effectively to at least double the number of dot positions available from the print head wire array, to make possible the use of a print head having fewer print wires than would otherwise be necessary to produce a suitably legible symbol, and to improve symbol legibility by providing closer dot spacing than would otherwise be possible from a single row wire array. In such mechanism, both of the support members are cylindrical, one extends through a bore in the print head assembly for sliding and pivotal movement thereon and the other support member is mounted on the frame for limited angular displacement about an axis parallel to and displaced from the axis of the other support member to move the print head assembly in a direction parallel to the paper support surface into one of two or more discrete positions to effectively at least double the number of dot positions available from the print head wire array.

The above and still further objects and features of the invention will become apparent from the following detailed description of a preferred embodiment thereof, together with the accompanying drawings.

DETAILED DESCRIPTION

Figures 1, 2, 3, 4:
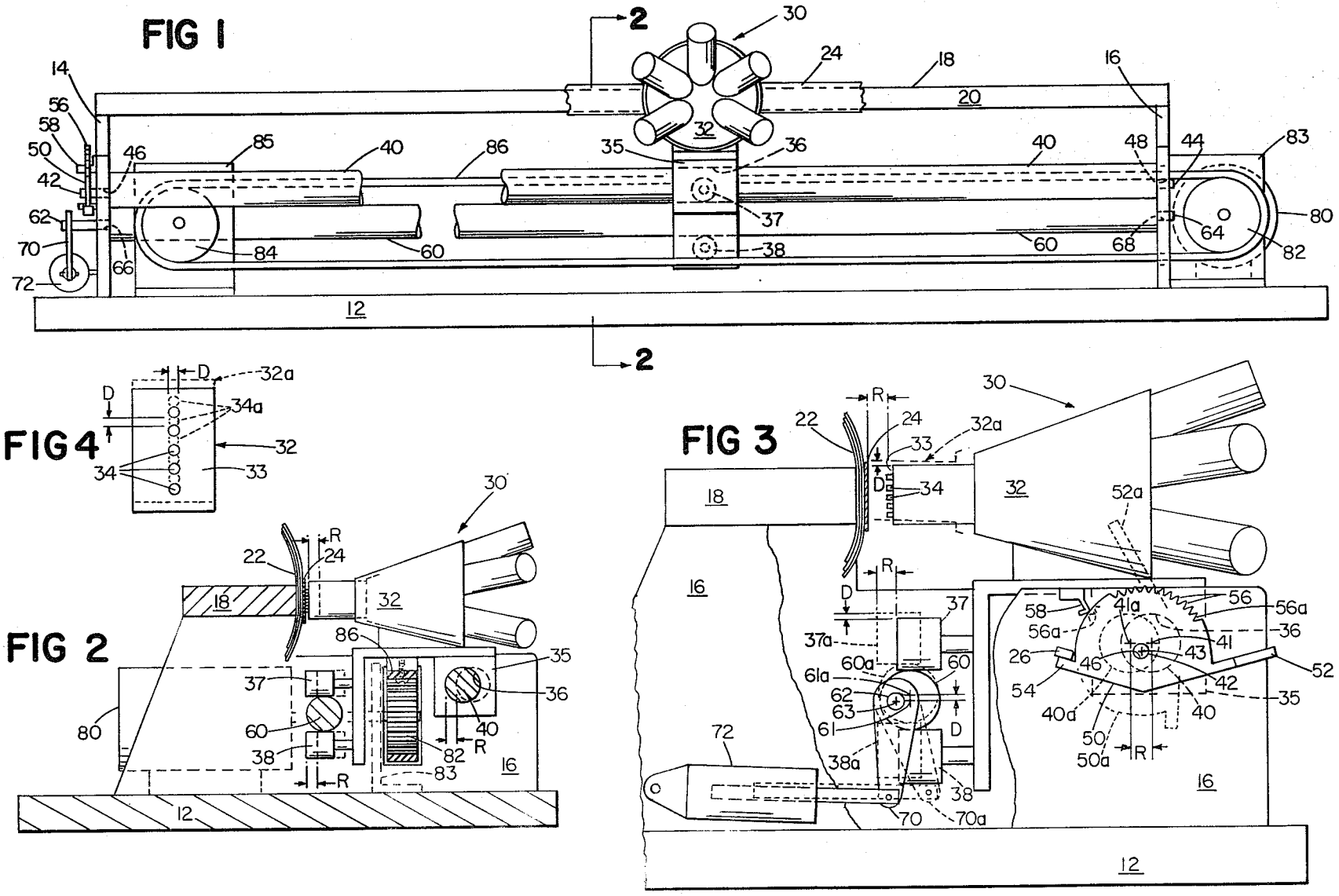
FIG. 1 is a somewhat diagrammatic front view of the printer of the invention.
FIG. 2 is a cross sectional view of the printer of FIG. 1, taken on the line 2—2 thereof.
FIG. 3 is an enlarged end view, partly broken away, of the printer of FIG. 1.
FIG. 4 is an enlarged front view of the dot matrix print head wire array of the printer of FIG. 1.

Referring to the drawings, the dot matrix or other printer of the invention includes a frame having a base 12, end plates 14 and 16 and a striker bar 18 providing a paper support surface 20 extending transversely between end plates 14 and 16. A print head assembly, generally designated 30, is supported and mounted for transverse movement parallel to paper support surface 20 on a pair of longitudinally spaced, transversely extending, cylindrical support members 40 and 60. Print head assembly 30 is moved transversely in a conventional manner by motor 80, pulleys 82 and 84 mounted on opposite ends of base 12 by means of brackets 83 and 85, and a timing belt 86 secured to print head assembly 30.

Print head assembly 30 is entirely conventional. It includes a dot matrix print head 32 having a front face 33 supporting in bores therein a single vertical array of five solenoid driven print wires 34 (FIG. 4) which are flush with face 33 is retracted position and extend outwardly therebeyond in operative position, as shown in FIGS. 2 and 3. Other print wire arrays can also be used, including different numbers of wires and multiple arrays, as is known in the art. Print head 32 is mounted on a carriage 35 having on its forward portion a bore 36 for receiving thereon front support rod 40 having a central axis 41 and a pair of vertically spaced cylindrical rollers 37 and 38, rotatable about horizontal axes perpendicular to the central axis 61 of rear support rod 60, on its rear portion for tangentially contacting the upper and lower surfaces of rear support rod 60. Print head assembly 30 is thus supported and guided by rods 40 and 60 for movement along a printing line on paper support surface 20 and is operated by conventional means known to the art to move its print wires 34 to print on one or more paper sheets 22 by means of an interposed ribbon 24 conventionally supported between it and paper support surface 20.

According to the present invention, either one or both of support rods 40 and 60 are mounted on frame end plates 14 and 16 for adjustment of face 33 of print head 32 in directions perpendicular to the line of printing, either or both toward and away from and parallel to paper support surface 20. These movements may also be utilized independently of one another, so that, if desired, only one or the other may be included in a printer of the present invention, either dot matrix printers of the type herein disclosed or other types of printers having a movable print head assembly, for example, "daisy" rotary wheel printers.

Referring first to the novel mechanism of the invention for adjusting the spacing of print head face 33 from the paper support surface 20 and for retracting it to facilitate paper and ribbon changing, this is accomplished by displacing front support rod 40 in a generally horizontal direction. To this end, front support rod 40 is rotatably eccentrically mounted on frame end plates 14 and 16 for angular displacement about an axis 43 parallel to and displaced from its own axis 41. More specifically, this is accomplished by providing front support rod 40 with cylindrical end extensions 42 and 44 having a common central axis 43 parallel to and displaced from the axis 41 of rod 40. Such end extensions are received within coaxial bearing bores 46 and 48 in frame end plates 14 and 16 for rotation therewithin.

As best shown in FIG. 3, in which the drive belt and pulley has been omitted for clarity, end extension 42 has mounted thereon an arcuate opening plate 50 having a finger portion 52 on its one side. A stop portion 54 is provided on its other side for contacting a stop element 26 on frame end plate 14 to define the limit of the retracting motion for ribbon changing. A plurality of notches 56 are provided on operating plate 50 for cooperating with a detent spring 58 mounted on end plate 14 for setting a desired spacing of print head face 33 from paper support surface 20 for accommodating multiple sheets of paper 22, for example.

In operation, the print head face 33 may be moved forward along a generally horizontal, curved path, from its fully retracted position, as shown in FIG. 3, to a forward position, as shown in FIG. 2, in which the detent spring 58 is engaged in one of notches 56 to provide the desired spacing, even while the print head assembly 30 is moving. The full range of movement toward and away from the paper support surface 20 is indicated by the approximate distance R, somewhat exaggerated in the drawings or clarity. As may be seen in FIG. 3, rotation of operating plate 50 in a counterclockwise direction toward its dotted line position **50*a* rotates front support rod 40 about the axis 43 of its end extension 42 to move it bodily from its fully retracted position 40 to its forward dotted position 40*a*, with the finger portion at 52*a* and with detent spring 58 engaged in the most clockwise notch 56*a*. Since support rod 40 is confined in bore 36 of carriage 35, this action moves the print head face 33 toward paper support surface 20 an approximately similar distance R, as shown in FIGS. 2 and 3, as well as sliding rollers 37 and 38 relatively to rear support rod 60 for an approximately similar distance R to positions 37*a* and 38*a* and slightly pivoting print head assembly 30 about rear support rod 60. However, since rear support rod 60 will be in effectively fixed position during this adjusting movement of front support rod 40, and since the print head face 33 and paper support surface 20 are positioned generally vertically above rear support rod 60, the vertical movement of print head face 33 during the arcuate, generally horizontal movement of print head assembly 30 is minimized, even though the horizontal motion produced by the rotation of front support rod 40 is arcuate rather than in a straight line. With multiple sheets of paper 22, operating plate 50 may be adjusted with detent spring 58 into any desired notch 56**, even while the printer is operating.

The novel mechanism of the invention for adjusting the vertical position of the print head into one of two or more discrete positions, such as position **32*a*, effectively at least doubling the number of dot positions available from the print head wire array, to make possible the use of a print head having fewer print wires than would otherwise be necessary to produce a suitably legible symbol and to improve symbol legibility by providing closer dot spacing than would otherwise be possible from a single row wire array, is also best shown in FIG. 3. It has been omitted from FIG. 2 for clarity. This is accomplished by displacing rear support rod 60 in a vertical direction to position 60***a*.

Referring first to FIG. 4, however, the ten dot column there illustrated is produced by a single vertical row of five print wires 34 having a diameter D and spaced from one another by a distance equal to D. Such spacing is not generally considered to provide adequate symbol legibility. However, by vertically displacing the print head face 33 upwardly for a distance D, so that the print head is positioned at 32*a* and the five print wires 34 are positioned at 34*a*, a ten dot column with tangentially contacting dots is produced, having entirely adequate legibility. With a continuously moving print head, displacement into one or the other of the two discrete positions on alternate sweeps or on the return sweep, over the same printing line, will provide the desired ten dot printed column.

Referring to FIGS. 2 and 3, the vertical position of print head face 33 is adjusted by displacing rear support rod 60 in a generally vertical direction for a distance of about D to position 60*a*, causing the print head assembly 30 to pivot upwardly on front support rod 40 and move print head face 33 upwardly for a distance D to position 32*a*. This is accomplished by providing rear support rod 60 with cylindrical end extensions 62 and 64 having a common axis 63 parallel to and displaced from the axis 61 of rear support rod 60. Such end extensions are rotatably received within bearing bores 66 and 68 in frame end plates 14 and 16, to rotatably eccentrically mount rear support rod 60 therein for angular vertical displacement about the axis 63 of end extensions 62 and 64, parallel to and displaced from its own axis 61. End extension 62 has mounted thereon a vertically extending operating lever 70 having a solenoid 72 connected to its end for moving it between its two discrete, displaced positions shown as its solid line position 70 and its dotted line position 70*a*.

In operation, solenoid 72 is operated to move lever 70 to the left in FIG. 3 to its dotted line position 70*a*. This motion bodily moves rear support rod 60 vertically clockwise about the axis of its extensions 62 and 64 from its lowered position at 60 through a distance of about D, somewhat exaggerated in FIG. 3 for clarity, to its raised position at 60*a*. Since rear supporting rod 60 is vertically confined between carriage rollers 37 and 38, as the rollers move to their upwardly displaced positions at 37*a* and 38*a*, print head assembly 30 pivots about forward support rod 40 and moves the print head 32 vertically upwardly for the desired distance D to its raised position 32*a*. Operation of solenoid 72 in the opposite sense acts to move print head 32 back to its lowered position. Print head face 33 is thus movable between two discrete, vertically spaced positions to effectively provide a ten dot column with tangentially contacting dots from a single five wire vertical array. Front support rod 40 will be in effectively fixed position during this movement of rear support rod 60. The distance D, which is herein shown as being approximately equal to the diameter of a print wire 34, is small enough so that the arcuate motions provided by the rotary movement both of rear support rod 60 and the pivotal movement of print head assembly 30 may be ignored in practice.

Other discrete vertical positioning could also be provided, for example, to displace the wire array upwardly for its entire length, to effectively produce a ten dot column of double the length of the five dot wire array, or to displace the wire array into three or more vertical positions, discrete or otherwise.

As was noted above, a printer according to the present invention may utilize either one or both of its aspects, horizontal movement for multiple paper sheet and paper and ribbon changing adjustment or vertical movement for vertical print wire matrix displacement. Thus, if only horizontal adjustment is desired, in the embodiments disclosed herein, rear support rod 60 may be mounted in fixed position on frame end plates 14 and 16. Conversely, if only vertical adjustment is desired, front support rod 40 may be so mounted. In addition, although the arrangement herein disclosed is preferred, it is contemplated that the functions of the front and rear support rods could be reversed, so that rotation of rear support rod 60 produces the horizontal movement and rotation of front support rod 40 produces the vertical movement.

What is claimed is:

1. A printer including a frame having end portions and a paper support surface extending transversely therebetween a print head assembly transversely movable along a printing line parallel to said surface and spaced therefrom and support means adjustably supporting and guiding said print head for said movement along said printing line and for adjustment in a direction perpendicular to said printing line said support means including a cylindrical print head assembly support member having a central axis parallel to said printing line bearing means mounting said support member on said frame for limited angular displacement about an axis fixed with respect to said frame and parallel to and displaced from the axis of said support member and operating means for angularly displacing said support member to move said print head assembly in said direction perpendicular to said printing line for adjustment thereof.

2. A printer as claimed in claim 1, wherein said support member extends through a bore in said print head assembly for sliding movement thereof.

3. A printer including a frame having end portions and a paper support surface extending transversely therebetween a print head assembly transversely movable along a printing line parallel to said surface and spaced therefrom and support means adjustably supporting and guiding said print head for said movement along said printing line and for adjustment in a generally horizontal direction perpendicular to said printing line toward and away from said paper support surface said support means including a pair of longitudinally extending print head assembly support members having axes parallel to said printing line one of said support members being cylindrical and extending through a bore in said print head assembly for sliding and pivotal movement thereon bearing means mounting said one support member on said frame for angular displacement about an axis fixed with respect to said frame and parallel to and displaced from the axis of said one support member and operating means for angularly displacing said one support member to move said print head assembly in a generally horizontal direction perpendicular to said printing line toward and away from said paper support surface.

4. A printer as claimed in claim 3, wherein said print head assembly is mounted on the other of said support members for movement parallel to said printing line and in a generally horizontal direction toward and away from said paper support surface.

5. A printer as claimed in claim 4, wherein said print head assembly has roller means rotatable about a horizontal axis perpendicular to the axis of said other support member supporting said print head assembly thereon.

6. A printer as claimed in claim 5, wherein said one support member is positioned forwardly of said other support member.

7. A printer as claimed in claim 6, wherein said paper support surface is positioned generally vertically above said other support rod.

8. A printer including a frame having end portions and a paper support surface extending transversely therebetween a print head assembly transversely movable along a printing line parallel to said surface and spaced therefrom and support means adjustably supporting and guiding said print head for said movement along said printing line and for adjustment in a generally vertical direction perpendicular to said printing line and generally parallel to said paper support surface said support means including a pair of longitudinally extending print head assembly support members having axes parallel to said printing line one of said support members being cylindrical and extending through a bore in said print head assembly for sliding and pivotal movement thereon bearing means mounting said other support member on said frame for limited angular displacement about an axis fixed with respect to said frame and parallel to and displaced from the axis of said other support member and operating means for displacing said other support member to move said print head assembly in a generally vertical direction perpendicular to said printing line and generally parallel to said paper support surface.

9. A printer including a frame having end portions and a paper support surface extending transversely therebetween a print head assembly transversely movable along a printing line parallel to said surface and spaced therefrom and support means adjustably supporting and guiding said print head for said movement along said printing line and for adjustment in directions perpendicular to said printing line both generally horizontally toward and away from said paper support surface and generally vertically and generally parallel to said paper support surface said support means including a pair of longitudinally extending cylindrical print head assembly support members each having a central axis parallel to said printing line one of said support members extending through a bore in said print head assembly for sliding and pivotal movement thereon, said print head assembly being mounted on the other of said support members for movement parallel to said printing line in a generally horizontal direction toward and away from said paper support surface bearing means mounting each of said support members of said frame for angular displacement about an axis fixed with respect to said frame and parallel to and displaced from the axis of its said support member and operating means for angularly displacing one of said support members to move said print head assembly in a generally horizontal direction toward and away from said paper support surface and the other of said support members in a generally vertical direction parallel to said paper support surface.

* * * * *